US005759240A

United States Patent [19]

Becker

[11] Patent Number: 5,759,240

[45] Date of Patent: Jun. 2, 1998

[54] LAMINAR FLOW ELECTROSTATIC PRECIPITATOR WITH SANDWICH STRUCTURE ELECTRODES

[75] Inventor: Andrew R. Becker, Ellicott City, Md.

[73] Assignee: Environmental Elements Corp., Baltimore, Md.

[21] Appl. No.: 787,052

[22] Filed: Jan. 28, 1997

[51] Int. Cl.[6] ..... B03C 3/08

[52] U.S. Cl. ..... 96/86; 96/87; 96/100

[58] Field of Search ..... 96/84–87, 95, 96/98, 100

[56] References Cited

U.S. PATENT DOCUMENTS

| | | | |
|---|---|---|---|
| 1,741,932 | 12/1929 | Gross | 52/302.1 |
| 1,801,515 | 4/1931 | Marshall | 96/96 |
| 2,108,795 | 2/1938 | Budd | 219/107 |
| 2,384,157 | 9/1945 | Burke | 428/593 |
| 2,575,181 | 11/1951 | Mack | 96/100 X |
| 2,602,519 | 7/1952 | Raper | 52/671 |
| 2,974,747 | 3/1961 | Coolidge, Jr. et al. | 96/69 |
| 3,363,372 | 1/1968 | Raynes | 52/91.3 |
| 3,386,227 | 6/1968 | Czerwonka | 96/85 |
| 3,416,540 | 12/1968 | Lidums | 96/85 X |
| 4,234,324 | 11/1980 | Dodge, Jr. | 55/DIG. 5 |
| 4,477,268 | 10/1984 | Kalt | 96/99 |
| 5,055,118 | 10/1991 | Nagoshi et al. | 96/88 |
| 5,282,891 | 2/1994 | Durham | 96/75 |
| 5,348,571 | 9/1994 | Weber | 96/68 |
| 5,474,600 | 12/1995 | Volodina et al. | 96/57 |

FOREIGN PATENT DOCUMENTS

| | | | |
|---|---|---|---|
| 240476 | 10/1987 | European Pat. Off. | 96/87 |
| 859870 | 1/1961 | United Kingdom | 96/100 |
| 80/00926 | 5/1980 | WIPO | 96/100 |

*Primary Examiner*—Richard L. Chiesa

*Attorney, Agent, or Firm*—Morton J. Rosenberg; David I. Klein; Jun Y. Lee

[57] ABSTRACT

A laminar flow electrostatic precipitator (200) is provided with a plurality of sandwich structure electrodes (100) alternatingly coupled to a respective one of a pair of output terminals (222, 224) of high voltage power supply (220). Each of the sandwich structure electrodes (100) includes a three layer electrode body (110, 110', 110") formed by a pair of plate members (112, 114) and a support structure (120, 120', 120") disposed between the pair of plate members for maintaining the plate members in a substantially flat contour. The spacing between the plurality of sandwich structure electrodes (100) and the velocity of gas flow there past is selected to achieve laminar flow and thereby maximize the particulate removal efficiency of the precipitator (200).

6 Claims, 3 Drawing Sheets

LAMINAR FLOW ELECTROSTATIC PRECIPITATOR WITH SANDWICH STRUCTURE ELECTRODES

BACKGROUND OF THE INVENTION

FIELD OF THE INVENTION

This invention directs itself to an electrostatic precipitation system having a laminar flow of gas therethrough. In particular, this invention provides a plurality of electrode plates alternately charged positive and negative disposed in spaced parallel relationship, the spacing between the plurality of plates and the gas flow velocity being selected to achieve laminar flow conditions. More in particular, this invention pertains to a laminar flow precipitator having a plurality of sandwich structure electrodes, each having a substantially flat and smooth contour. Further, this invention directs itself to an electrode structure wherein a pair of plate members formed of an imperforate electrically conductive material are secured in spaced parallel relationship with a support structure disposed therebetween and fixedly secured to respective rear surfaces of each of the plate members for maintaining the substantially flat contour of each of the plate members.

PRIOR ART

Electrostatic precipitators and sandwich structures are well known in the art. The best prior art known to the Applicant include U.S. Pat. Nos. 1,741,932; 2,384,157; 2,108,795; 3,363,372; 5,348,571; 4,234,324; 3,386,227; 5,282,891; 5,055,118; 2,974,747; 4,477,268; 2,602,519; 5,474,600; and, 1,801,515.

Conventional industrial electrostatic precipitators collect dry particulates in a parallel plate, horizontal flow, negative-polarity, single-stage system design. Collecting plate spacing generally ranges from 9–16 inches, and have electrodes that are typically up to 15 feet wide with heights that can range up to 50 feet. Flow through the precipitator is always well into the turbulent range, and due to such turbulent flow, precipitator collector efficiency is predicted utilizing the Deutsch model. The Deutsch model assumes that the turbulence causes complete mixing of the particles in the turbulent core of the flow gas, and electrical forces are operative only across the laminar boundary layer. This model leads to an exponential equation that relates collection efficiency to the product of the electrical migration velocity of the particles and the specific collecting area of the precipitator. Thus, any attempt to increase collection efficiency levels by increasing the specific collecting area yields diminishing returns, due to the exponential nature of the relationship between the variables. Therefore, the 100% collection efficiency level is approached only asymptotically in the turbulent flow case and cannot in actuality be reached, no matter how large the precipitator.

It has long been known that laminar flow precipitation provides many advantages over turbulent flow. In laminar flow, the flow stream lines are parallel and in the direction of flow; there is no force causing particles near the collecting surface to be thrown back into the central flow region. Therefore, the electrical forces tending to move the particles toward the collecting surface are effective across the entire flow cross-section, not just across a laminar sublayer. As a result, the equation which relates collection efficiency to the product of the electrical migration of the particles and the specific collecting area defines a linear relationship, whereby 100% collection efficiency is possible and practical.

The plate electrodes in conventional turbulent flow precipitators require reinforcement due to the large distances they span. That reinforcement is often in the form of integrally formed stiffening ribs or corrugations, as well as by attachment of stiffening frames or brackets to the electrode plates. Such methods for providing structural support of the plate electrodes are totally unsuitable for use in a laminar flow precipitator. Further, as the distance between plate electrodes is substantially less in a laminar flow precipitator, the flatness of each electrode is far more critical. Any occurrence of a corona discharge between the electrodes would create a turbulent flow in the gas stream and reduce the efficiency of the precipitator. Thus, the flatness of each electrode must be maintained across the expanse of the electrode surface and throughout the operating temperature range which the precipitator is expected to experience.

Heretofore, the only structure having sufficient structural rigidity with substantially smooth surface contours for use in a laminar flow precipitator has been formed from tubular material, having either circular or polygonal cross-sectional contours. The gas stream would be subdivided to flow through a plurality of parallel tubes, each tube forming one electrode, with the other electrode being formed by a wire or probe that extends into or through the center of each such tube.

While the tubular electrode arrangement provides for practical implementation of a laminar flow precipitator, such requires vertical gas flow therethrough, as opposed to horizontal, to facilitate removal of the collected particulates. Therefore, conversion of a conventional turbulent flow precipitator to laminar flow is impractical, and in most instances requires complete replacement of the conventional precipitator with a new laminar flow unit. Such replacement is further complicated by the changes required to accommodate the vertical gas flow of the laminar flow precipitator. However, utilizing the electrode structure of the instant invention it is now possible to produce industrial laminar flow electrostatic precipitators with a horizontal gas flow. The horizontal laminar flow precipitator of the instant invention is easily substituted for conventional units. Further, it is now practical to convert a conventional horizontal flow electrostatic precipitator to a laminar flow precipitator, utilizing sandwich plate electrodes of the instant invention. The higher efficiency of particulate removal achieved with laminar flow also allows the surface area of the sandwich plate electrodes to be reduced over that of the conventional precipitator electrodes they replace.

SUMMARY OF THE INVENTION

A laminar flow electrostatic precipitator and plate electrode structure therefor is provided. The laminar flow electrostatic precipitator includes a power supply for providing a high voltage between a pair of output terminals. The laminar flow electrostatic precipitator also includes a plurality of parallel spaced longitudinally extended electrodes disposed in a longitudinally directed flow of gas. The plurality of electrodes are alternatingly coupled to a respective one of the pair of power supply output terminals. The plurality of electrodes have substantially smooth and flat longitudinally directed surfaces spaced one from another by a predetermined dimension to establish a laminar flow of the gas. Each of the plurality of electrodes is formed by a three layer sandwich structure.

DESCRIPTION OF THE PREFERRED EMBODIMENT

Figure 3:
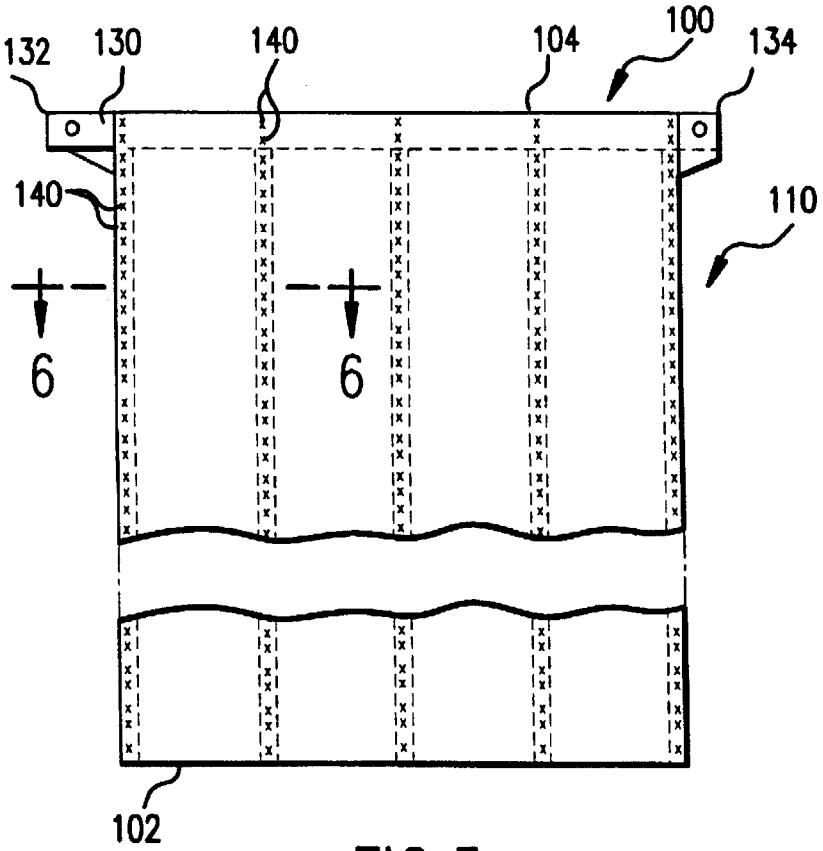
FIG. 3 is an elevation view of an electrostatic precipitator electrode of the present invention.
Figure 4:
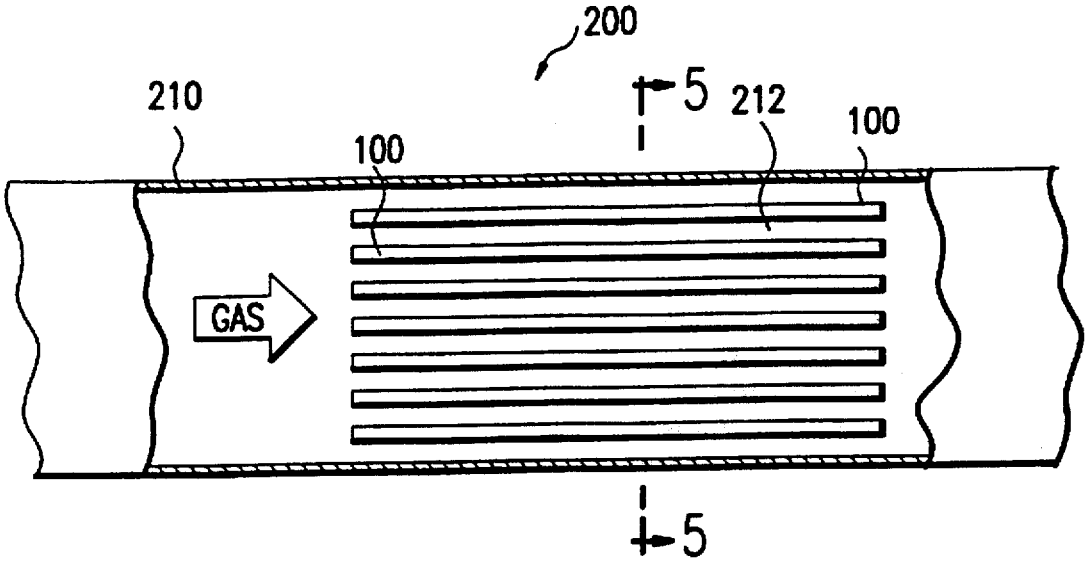
FIG. 4 is a plan view of the laminar flow electrostatic precipitator of the present invention.
Figure 5:
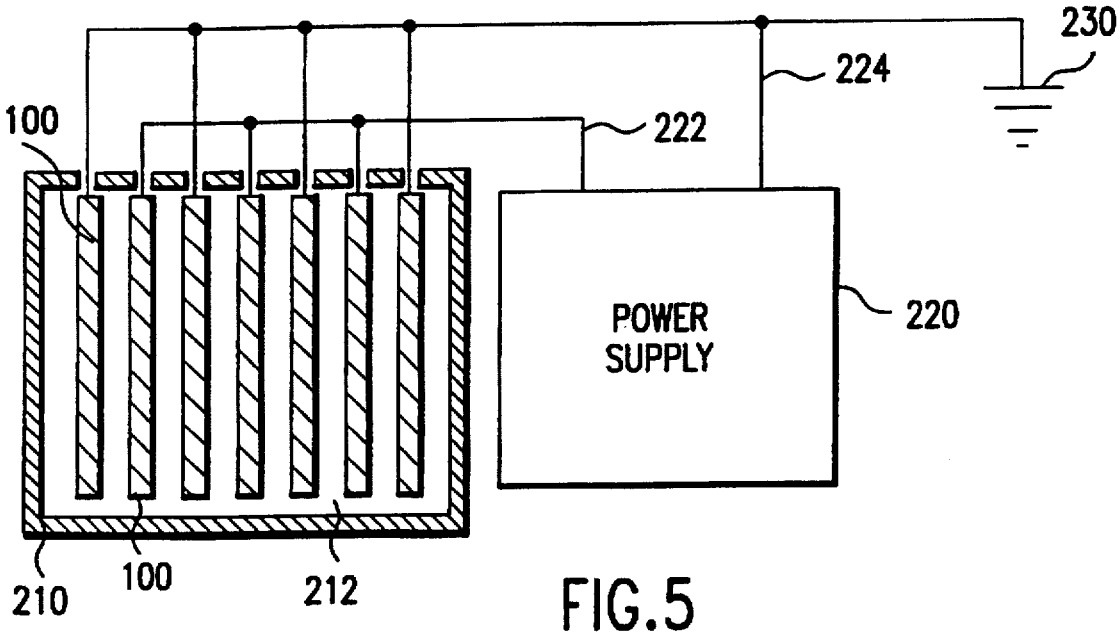
FIG. 5 is a partial cross-sectional diagrammatic view of the electrostatic precipitator of the present invention taken along the section line 5—5 of FIG. 4.

Referring now to FIGS. 3–5, there is shown, laminar flow electrostatic precipitator 200 for removing particulates from a gas stream. As will be seen in following paragraphs, laminar flow electrostatic precipitation system 200 incorporates a plurality of novel sandwich structure electrodes 100, each of which being provided with a sufficiently stiffened structure to maintain the outwardly directed surfaces 111, 115 thereof in a substantially smooth and flat condition. Laminar flow is desired, since the efficiency of particulate removal can reach substantially 100% under laminar flow conditions. Laminar flow, however, cannot be achieved if turbulence is introduced into the gas stream, and thus the plate electrodes of precipitator 200 cannot have any protrusions or recesses that would influence the gas flow.

Figure 2A:
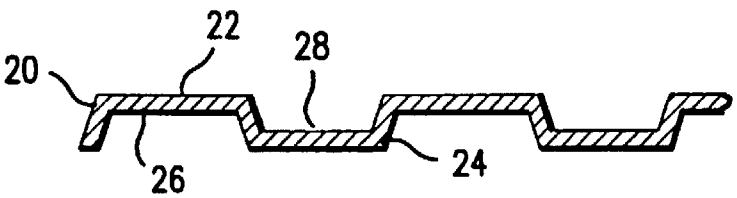
FIG.2A PRIOR ART
FIG. 2A is a cross-sectional view of the prior art electrostatic precipitator electrode taken along the section line 2—2 of FIG. 1.
Figure 2B:
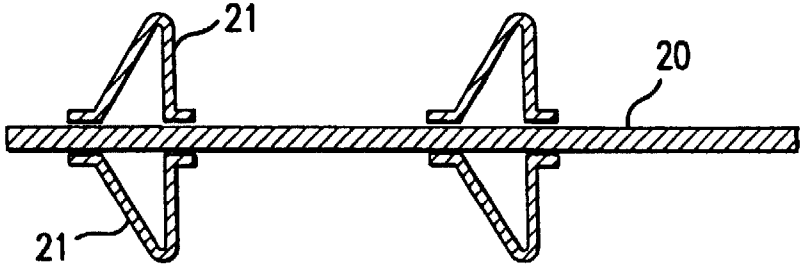
FIG.2B PRIOR ART
FIG. 2B is a cross-sectional view of another prior art electrostatic precipitator electrode configuration taken along the section line 2—2 of FIG. 1.
Figure 1:
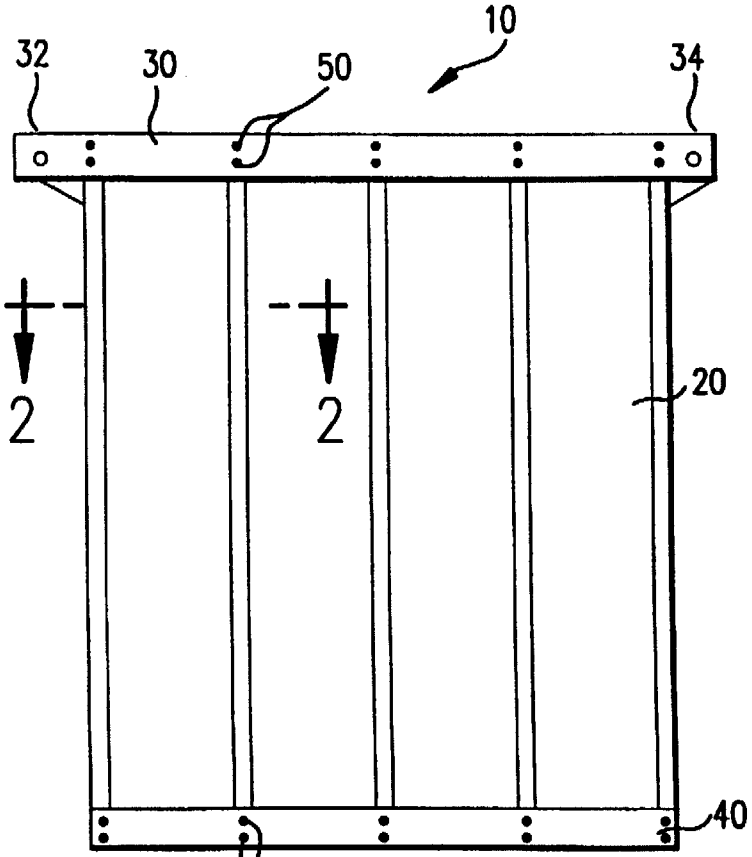
FIG.1 PRIOR ART
FIG. 1 is an elevation view of a prior art electrostatic precipitator electrode.

Commercial electrostatic precipitators are very large, having electrode plates ranging in size from 3 feet×6 feet to 15 feet×50 feet. While the electrode spacing dimensions in a conventional electrostatic precipitator are not as critical as that required in a laminar flow precipitator, such as precipitator 200, some stiffening of the conventional plate electrode is required. Two typical methods of providing such stiffening in conventional electrostatic precipitators is shown in FIGS. 1, 2A and 2B. The conventional precipitator electrode 10 of FIGS. 1 and 2A is formed by a corrugated plate member 20 supported on an upper end thereof by a mounting member 30, the mounting member 30 having mounting portions 32 and 34 extending from opposing ends thereof. The lower edge of the corrugated plate member is supported by a bottom member 40. Typically, the mounting member 30 and bottom member 40 are secured to the corrugated plate member 20 by means of a plurality of fasteners 50, such as nut and bolt type fasteners. Corrugated plate member 20 is provided with a plurality of first projections 22 extending from one side of the plate 20 and a plurality of second projections 24 extending from the opposing side. In each case, where a projection 22 extends from one side of plate 20, such forms a recess 26 on the opposing side. Likewise, a recess 28 is formed on the opposing side of plate member 20 from each second projection 24. While this arrangement provides a sufficiently stiff electrode plate for operation within a conventional electrostatic precipitator, such is totally unusable in a laminar flow precipitator since the alternating arrangement of projections 22, 24 and recesses 28, 26 cause turbulence in the gas stream as it flows there past. Other prior art plate electrode structures, as shown in FIG. 2B, have stiffening members 21 secured to the external surfaces of each side of the plate 20. Prior art plate electrodes are also known to have stiffening ribs formed in one side thereof or spaced wave-like patterns formed therein. Each of those other alternative structures introduce turbulence into the gas flow, and are unsuitable for use in precipitator 200.

The laminar flow through precipitator 200 is achieved in-part by passing the gas through a plurality of substantially parallel sandwich structure electrodes 100 having a predetermined spacing 212 therebetween and at a predetermined velocity. A velocity approximating 5 feet per second may be utilized to achieve a Reynolds number less than 2000. The well established Reynolds number is a dimensionless factor represented by the equation:

$$Re=DV/v$$

where:

D is the distance between the parallel plates,

V is the mean velocity of the fluid, v is the kinetic viscosity of the fluid.

To achieve laminar flow, $Re<2000$ must be satisfied. By maintaining a relatively small spacing between electrodes and a relatively low velocity of gas flow, the conditions for laminar flow are met.

Figure 6:
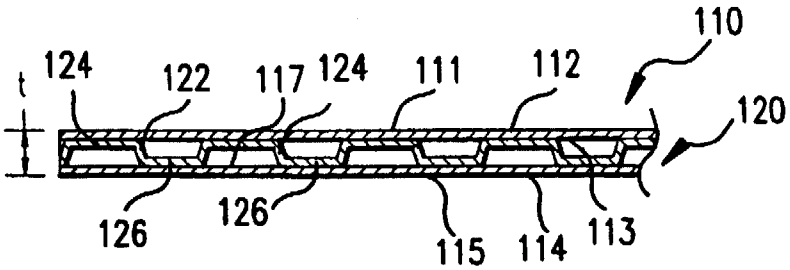
FIG. 6 is a cross-sectional view of the electrode of the present invention taken along the section line 6—6 of FIG. 3.

Thus, for a laminar flow electrostatic precipitator each electrode plate must be substantially smooth and substantially flat so as not to introduce any turbulence into the gas flow. As the electrode plates must extend a substantial distance, 4–8 feet in width and 20 feet or more in length, a structure is required that is substantially rigid. A sufficiently rigid structure cannot be achieved, for all practical purposes, with a single unreinforced sheet of material. The sandwich structure electrode 100, shown in FIGS. 3 and 6, overcomes those problems, providing substantially smooth and flat electrode surfaces with a substantially rigid structure for electrodes having lengths of 24 feet or more.

Sandwich structure electrode 100 includes a three layer electrode body 110 extending in both a longitudinal direction and a direction transverse the longitudinal direction. Electrode 100 is supported within the precipitator 200 by means of a mounting member 130 extending longitudinally at the upper end of the electrode body 110 and secured thereto. Mounting member 130 includes respective mounting portions 132 and 134 extending from opposing ends thereof and extending beyond the longitudinal dimension of the electrode body. The mounting portions 132 and 134 have a particular configuration dictated by the particular structure of the precipitator into which they are installed, and such is not important to the inventive concepts being disclosed herein.

The sandwich structure of electrode 100 is defined by a first plate member 112 which is maintained in spaced parallel relationship with a second plate member 114 by a support structure 120. Each of the first and second plate members 112, 114 extend continuously in both the longitudinal direction and the transverse direction, the full extent of the electrode body 110. Each of the first and second plate members 112, 114 are relatively thin sheets of imperforate and electrically conductive material, having a thickness in the approximating range of 0.015–0.050 inches. Exemplary conductive materials from which first and second plate members 112, 114 may be formed include copper, aluminum, steel, and alloys thereof, and conductively treated composites or plastics.

Support structure 120 may be formed by a corrugated sheet member 122 having a plurality of first raised surfaces 124 extending in one direction, and a plurality of second raised surfaces 126 extending in an opposite direction, each of the respective first and second raised surfaces 124, 126 are secured to respective rear surfaces 113, 117 of the first and second plate members 112, 114. At least a portion of the plurality of first and second raised surfaces 124, 126 are secured to the respective first and second plate members 112, 114 by such means as spot welding. Thus, each respective plate member 112, 114 is joined to the support structure 120 by a plurality of rows of spot welds 140 or other non-protruding fastening methods. Where the temperature of the gas stream permits, adhesives may be utilized to join the first and second plate members 112, 114 to the support structure 120. It is not necessary that support structure 120 provide electrical coupling between plate members 112 and 114, as long as other means are provided to ensure that they are at the same potential. Other mechanical means may be utilized to secure support structure 120 to plate members 112 and 114, as long as such maintains the smoothness of the front surfaces 111, 115 of plate members 112, 114, as it is critically important that there be no disruption of the surface contour which could induce turbulence in the gas stream flow. The sandwich structure, thus produced, has an overall thickness t in the approximating range of 0.25–0.375 inches, with an overall weight which is comparable to that of the conventional plate electrode 10, shown in FIG. 1.

Figure 7:
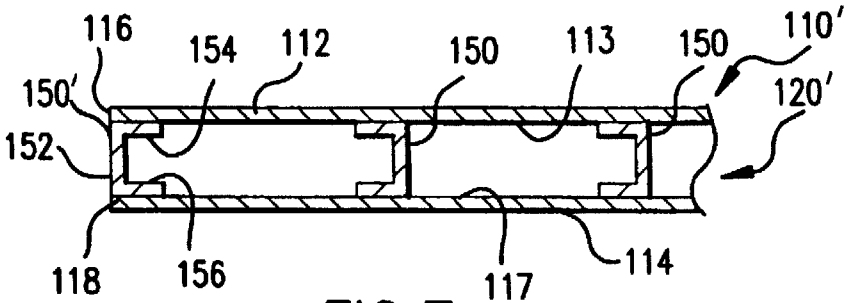
FIG. 7 is a cross-sectional view of another configuration for the electrode of the present invention taken along the section line 6—6 of FIG. 3; and, FIG. 8 is a cross-sectional view of yet another configuration for the electrode of the present invention taken along the section line 6—6 of FIG. 3.

The sandwich structure of electrode 100 can take alternate forms. The electrode 100 may have a three layer electrode body 110', shown in FIG. 7, wherein the two electrode plates 112 and 114 are maintained in spaced parallel relationship by the support structure 120'. Support structure 120' is formed by a plurality of longitudinally spaced support members 150. Each of the support members extends in the transverse direction and has a first face secured contiguous to the rear surface 113 of plate 112, and a second face secured contiguous to the rear surface 117 of plate member 114. Each of the support members 150 is formed by a channel-shaped member having a C-shaped cross-sectional contour. In order to provide a closed flush end for the electrode 100, the endmost support member 150' has a back portion 152 juxtaposed flush with the end surfaces 116, 118 of plates 112, 114 to form a smooth and continuous end surface for electrode 100. Therefore, the endmost support member 150' has its respective leg portions 154, 156 extending in a direction opposite the respective leg portions of the other support members 150.

Figure 8:
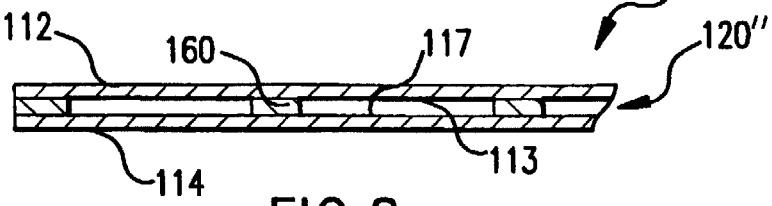

While the corrugated configuration of sheet member 122 and the C-shaped channels 150 provide great rigidity and support for the plate members 112, 114, other support member configurations may also be utilized. As shown in FIG. 8, the three layer electrode body 110" includes a support structure 120' for maintaining the spaced parallel relationship of the plate members 112 and 114. The support structure 120' includes a plurality of longitudinally spaced support members 160 in the form of flat bars, having a rectangular cross-sectional contour. Each of the support members 160 extend in the transverse direction and are secured on opposing faces thereof in contiguous relationship with the respective rear sides 113, 117 of plate members 112, 114. Each of the support members 160 may be secured to each of plate members 112 and 114 by such means as spot welding, other non-protruding fastening methods, or an adhesive composition, where temperatures permit. Temperature permitting, the support structure 120, 120', 120" may be formed of a non-metallic material, such as a composite material, in place of metallic elements where other means for electrically coupling plate member 112 to plate member 114 are provided. Such electrical coupling may be provided by the mounting member 130 and the means by which it is coupled to the plate members 112, 114.

The support structure 120, 120', 120" does not extend the full transverse dimension of the three layer electrode body 110, 110', 110", but extends from the lower end 102 of the electrode to a location a predetermined distance from the upper end 104, that distance being equivalent to the height dimension of the mounting member 130. Thus, the member 130 is disposed between the two plate members 112, 114 adjacent the upper end 104 of the electrode 100, and is secured to each of the plate members by spot welds 140, or other appropriate means.

As shown in FIG. 4, a plurality of the electrodes 100 are disposed in spaced parallel relationship in a horizontally directed flow of gas within a duct or housing 210. Each of the electrodes 110 is separated from an adjacent electrode by a space 212, which space defines an electrode spacing within the approximating range of 1.0–3.0 inches. It has been found that when the spacing exceeds 3.0 inches, a region of turbulent flow may be formed, reducing the high efficiency which is otherwise achievable when laminar flow is maintained within.

As shown in FIG. 5, energy is supplied to the plurality of electrodes 100 by means of the high voltage power supply 220. Power supply 220 generates a high voltage differential between a pair of output terminals 222 and 224. The plurality of electrodes 100 are alternatingly coupled to a respective one of the pair of power supply output terminals 222, 224, such that adjacent electrodes carry opposite charges. As is customary, one of the power supply output terminals 224 is coupled to a ground reference potential 230. Although a single set of parallel plates is shown, the precipitator may be formed by multiple stages, with a preceding stage operating at a different potential, or operating as a charging section, with the laminar flow being formed in the section 200 utilizing the plurality of sandwich structure electrodes 100.

In summary, high efficiency collection of particulates can be achieved in large commercial precipitators by providing laminar flow of the gas stream. Precipitator 200 achieves laminar horizontal flow by providing a plurality of parallel spaced sandwich structure electrodes 100, the electrodes being spaced by a distance approximating 1.0–3.0 inches. Each of the electrodes 100 is provided with substantially smooth and flat external surfaces 111, 115 by means of a support structure 120, 120', 120" secured between a pair of plate members 112 and 114. The support structure 120, 120', 120" provides the necessary structural rigidity to support electrodes having lengths extending from 6–24 feet, while not inducing any turbulence in the gas stream flow.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A laminar flow electrostatic precipitator plate electrode sandwich structure, comprising:

a first plate member having opposing front and rear surfaces extending in both a longitudinal direction and a direction transverse said longitudinal direction, at least said front surface having a substantially smooth and substantially flat contour, said first plate member being formed of an imperforate electrically conductive material;

a second plate member coupled to said first plate member in spaced parallel relationship, said second plate member having opposing front and rear surfaces extending in both said longitudinal and said transverse directions, at least said front surface of said second plate member having a substantially smooth and substantially flat contour, said second plate member being formed of an imperforate electrically conductive material; and, structural support means disposed between said first and second plate members for coupling said first plate member to said second plate member and maintaining said substantially flat contour of said front surfaces of each said first and second plate members, said structural support means being fixedly secured to said rear surfaces of each said first and second plate members, said structural support means including a corrugated sheet member extending in both said longitudinal and said transverse directions, said corrugated sheet member having a plurality of first and second raised surfaces respectively alternatingly directed in opposing directions, at least a portion of said first raised surfaces being secured to said rear surface of said first plate member and at least a portion of said second raised surfaces being secured to said rear surface of said second plate member.

2. The laminar flow electrostatic precipitator plate electrode sandwich structure as recited in claim 1 where said front surface of said second plate member is spaced from said front surface of said first plate member by approximately 0.25–0.375 inches.

3. A laminar flow electrostatic precipitator plate electrode sandwich structure, comprising:

a first plate member having opposing front and rear surfaces extending in both a longitudinal direction and a direction transverse said longitudinal direction, at least said front surface having a substantially smooth and substantially flat contour, said first plate member being formed of an imperforate electrically conductive material:

a second plate member coupled to said first plate member in spaced parallel relationship, said second plate member having opposing front and rear surfaces extending in both said longitudinal and said transverse directions, at least said front surface of said second plate member having a substantially smooth and substantially flat contour, said second plate member being formed of an imperforate electrically conductive material; and, structural support means disposed between said first and second plate members for coupling said first plate member to said second plate member and maintaining said substantially flat contour of said front surfaces of each said first and second plate members, said structural support means being fixedly secured to said rear surfaces of each said first and second plate members, said structural support means including a plurality of longitudinally spaced support members, each of said support members extending in said transverse direction and having a first face secured contiguous to said rear surface of said first plate member and a second face secured contiguous to said rear surface of said second plate member, each of said plurality of support members having a C-shaped cross-sectional contour, each longitudinally endmost one of said plurality of C-shaped support members being oriented in a direction to form a flush closed end of said plate electrode.

4. A laminar flow electrostatic precipitator and plate electrode structure therefor, comprising:

power supply means for providing a high voltage between a pair of output terminals; and, a plurality of parallel spaced longitudinally extended electrodes disposed in a longitudinally directed flow of gas, said plurality of electrodes being alternatingly coupled to a respective one of said pair of power supply output terminals, said plurality of electrodes having substantially smooth and flat longitudinally directed surfaces spaced one from another by a predetermined dimension to establish a laminar flow of the gas, each of said plurality of electrodes being formed by a three layer sandwich structure, said three layer sandwich structure including:

a. a first plate member having opposing front and rear surfaces extending in both a longitudinal direction and a direction transverse said longitudinal direction, at least said front surface having a substantially smooth and substantially flat contour, said first plate member being formed of an imperforate electrically conductive material;

b. a second plate member coupled to said first plate member in spaced parallel relationship, said second plate member having opposing front and rear surfaces extending in both said longitudinal and said transverse directions, at least said front surface of said second plate member having a substantially smooth and substantially flat contour, said second plate member being formed of an imperforate electrically conductive material; and, c. structural support means disposed between said first and second plate members for coupling said first plate member to said second plate member and maintaining said substantially flat contour of said front surfaces of each said first and second plate members, said structural support means including an electrically conductive corrugated sheet member extending in both said longitudinal and said transverse directions, said corrugated sheet member having a plurality of first and second raised surfaces respectively alternatingly directed in opposing directions, at least a portion of said first raised surfaces being secured to said rear surface of said first plate member and at least a portion of said second raised surfaces being secured to said rear surface of said second plate member.

5. The laminar flow electrostatic precipitator and plate electrode structure as recited in claim 4 where said plurality of electrodes are spaced one from another a dimension within the approximating range of 1.0–3.0 inches.

6. The laminar flow electrostatic precipitator and plate electrode structure as recited in claim 4 where said front surface of said second plate member is spaced from said front surface of said first plate member by approximately 0.25–0.375 inches.

* * * * *